United States Patent [19]

Tanaka et al.

[11] Patent Number: 4,966,090

[45] Date of Patent: Oct. 30, 1990

[54] FABRIC EDGE TRACE STITCHING SYSTEM

[75] Inventors: Takahumi Tanaka, Nagoya; Nobuyasu Ooshima, Kounan, both of Japan

[73] Assignee: Brother Kogyo Kabushiki Kaisha, Japan

[21] Appl. No.: 400,775

[22] Filed: Aug. 30, 1989

[30] Foreign Application Priority Data

Sep. 2, 1988 [JP] Japan ..... 63-220651

[51] Int. Cl.[5] ..... D05B 3/02

[52] U.S. Cl. ..... 112/456; 112/153; 112/306

[58] Field of Search ..... 112/456, 453, 457, 153, 112/121.11, 306, 443, 308

[56] References Cited

U.S. PATENT DOCUMENTS 4,823,716 4/1989 Nakashima ..... 112/453
4,827,858 5/1989 Horie et al. ..... 112/153 X

FOREIGN PATENT DOCUMENTS 62-68482 9/1985 Japan .
257675 11/1986 Japan .
63-277090 5/1987 Japan .

*Primary Examiner*—Peter Nerbun
*Attorney, Agent, or Firm*—Oliff & Berridge

[57] ABSTRACT

A fabric edge trace stitching system in combination with an electronically controlled zigzag sewing machine comprising a driving actuator for changing the relative position of the needle and the work fabric in the direction perpendicular to the fabric feed direction, is for forming a seam tracing along an edge of the work fabric, and comprises a fabric edge detecting device, a trace width setting device, a signal compensating device for forming a smooth and approximate seam as the plain seam or a precise seam as the stitch seam, a stitch position control decive for controlling a stitching position of the needle through a swing control device, and a switching device for selecting one of the signal processing devices in the signal compensating device.

4 Claims, 5 Drawing Sheets

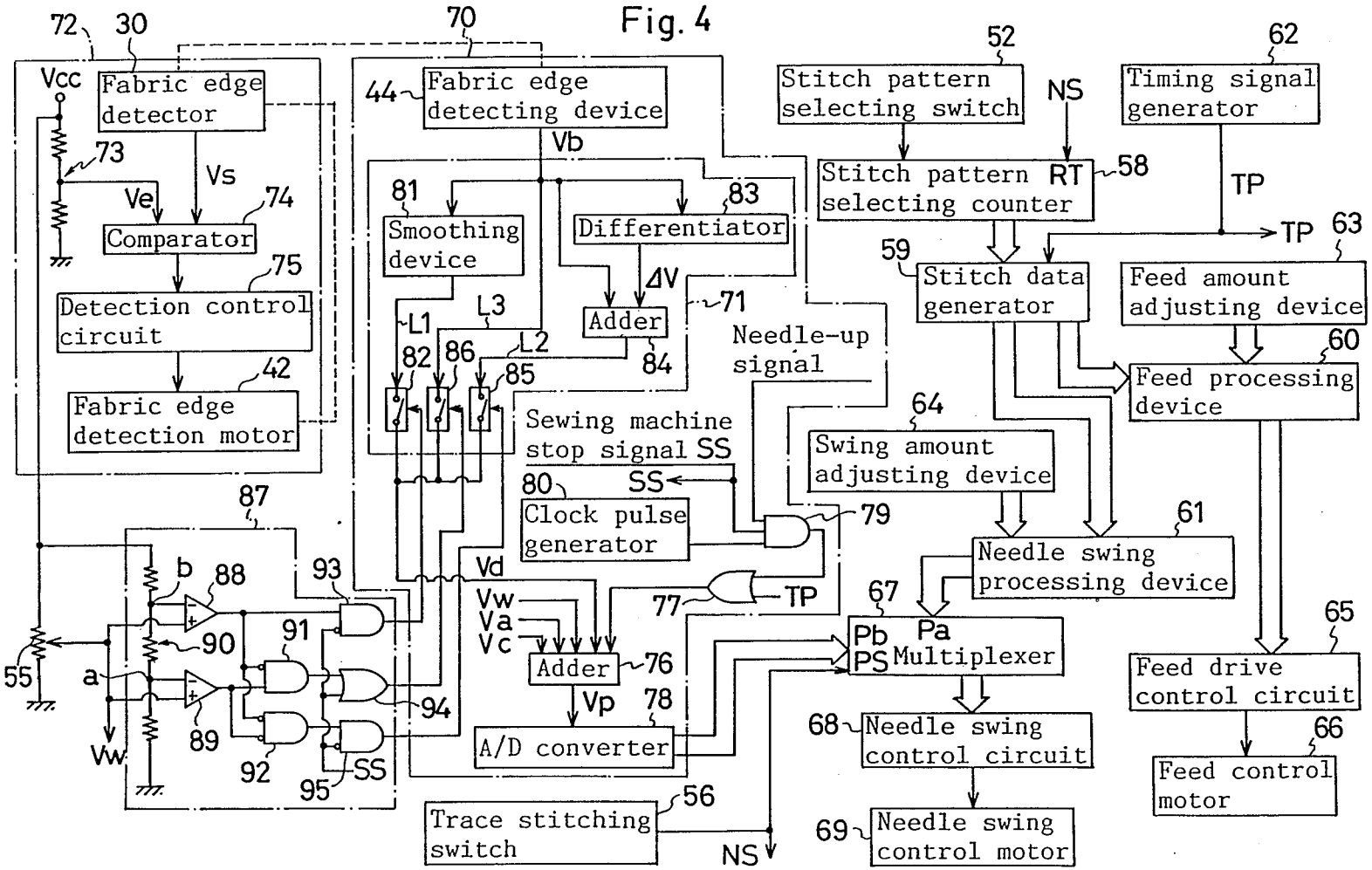
Fig. 4
Timing signal generator
62
TP
Feed amount adjusting device
63
Feed processing device
60
Feed drive control circuit
65
Feed control motor
66
Stitch pattern selecting switch
52
NS
Stitch pattern selecting counter
58
RT
Stitch data generator
59
Needle swing processing device
61
Swing amount adjusting device
64
Multiplexer
67
Pa
Pb
PS
Needle swing control circuit
68
Needle swing control motor
69
Needle-up signal
71
Differentiator
83
ΔV
Adder
84
Fabric edge detecting device
44
Vb
Smoothing device
81
L1
L2
L3
85
86
82
Sewing machine stop signal SS
SS
Clock pulse generator
80
79
77
Adder
76
Vp
A/D converter
78
Vd
Vw
Va
Vc
Trace stitching switch
56
70
Fabric edge detector
30
Vs
Ve
Comparator
74
Detection control circuit
75
Fabric edge detection motor
42
Vcc
72
73
87
88
89
90
91
92
93
94
95
b
a
Vw
55

FABRIC EDGE TRACE STITCHING SYSTEM

BACKGROUND OF THE INVENTION

The present invention relates to a sewing machine for trace stitching along the stitching line distant from the edge of the work fabric by a desired distance, and more specifically to a fabric edge trace stitching system in which the degree of tracing along the fabric edge is changeable.

Generally, such an electronically controlled zigzag sewing machine for trace stitching along the stitching line distant from the fabric edge by a desired distance is already in practical use.

For example, the Japanese Patent Publication (not examined) No. 61-257675 discloses a zigzag sewing machine for trace stitching comprising a needle swing mechanism driven with a needle swing control motor, a fabric edge detector installed on the needle bar supporting member of the needle swing mechanism which includes a light-emitting device for emitting infrared rays and a light-receiving device for receiving reflected infrared rays reflected at a reflecting surface provided on the throat plate, and a control means for controlling the lateral position of the fabric edge detector through the needle swing control motor so as to trace the fabric edge based on the trace width setting signal from a trace width setting volume and the detected voltage representing total amount of the reflected infrared rays. This sewing machine facilitates to form a seam along the stitching line distant from the fabric edge by a desired distance by controlling the fabric edge detector to trace the fabric edge.

Furthermore, the Japanese Patent Publication (not-examined) No. 63-277090 discloses the same kind of a sewing machine which comprises a timing pulse generator and a control means for storing and renewing the past newest four detected position signals output from the fabric edge detector in syhchronism with the timing pulse and for determining the average of above four detected position signals as the next needle position.

The fabricating process for fabricating utility goods made of the fabric includes various steps such as a step for cutting the work fabric, a step for forming the plain seam and a step for forming the stitch seam.

In case of the plain seam, it is useless to form a seam tracing precisely along the fabric edge because of frayed (loosen) portions or roughly cut portions on the fabric edge, and therefore it is preferrable to form a seam tracing smoothly and approximately along the fabric edge.

On the other hand, in case of the stitch seam, since the stitch seam is formed along the folded fabric edge in many cases, it is preferrable to form a seam tracing precisely along the folded fabric edge.

However, the sewing machine disclosed in the former patent publication is suitable for the stitch seam tracing precisely along the fabric edge, but this sewing machine is not suitable for the plain seam. In the sewing machine disclosed in the latter patent publication, since each stitching position is determined based on the average of the past four stitching positions, this sewing machine is suitable for the plain seam tracing smoothly and approximately along the fabric edge, but this sewing machine is not suitable for the stitch seam.

SUMMARY OF THE INVENTION

The object of the present invention is to make it possible to change the degree of tracing along an edge of the work fabric in a fabric edge trace stitching system in combination with a sewing machine.

A fabric edge trace stitching system according to the present invention is in combination with an ordinary electronically controlled zigzag sewing machine or an electronically controlled sewing machine comprising a lateral feed mechanism for feeding the work fabric in a direction perpendicular to the feed direction for feeding the work fabric.

This fabric edge trace stitching system is characterized by comprising; a fabric edge detecting means for detecting an edge of the work fabric on the bed; a trace width setting means for setting a trace width from the fabric edge to a stitching position; a signal compensating means for receiving a fabric edge position signal supplied from the fabric edge detecting means, and including a signal smoothing means for smoothing the fabric edge position signal and a signal passing means for passing the fabric edge position signal without processing; a stitch position control means for commanding the drive control means to control the driving actuator so as to stitch at the stitching position distant from the fabric edge by the trace width set with the trace width setting means, based on the fabric edge position signal supplied from the signal compensating means; and a switching means for switching one of the signal smoothing means and the signal passing mean to be operative.

BRIEF DESCRIPTION OF THE DRAWINGS

FIG. 4 is a block diagram of the control system of the sewing machine in FIG. 1.

DESCRIPTION OF THE PREFERRED EMBODIMENTS

Figure 1:
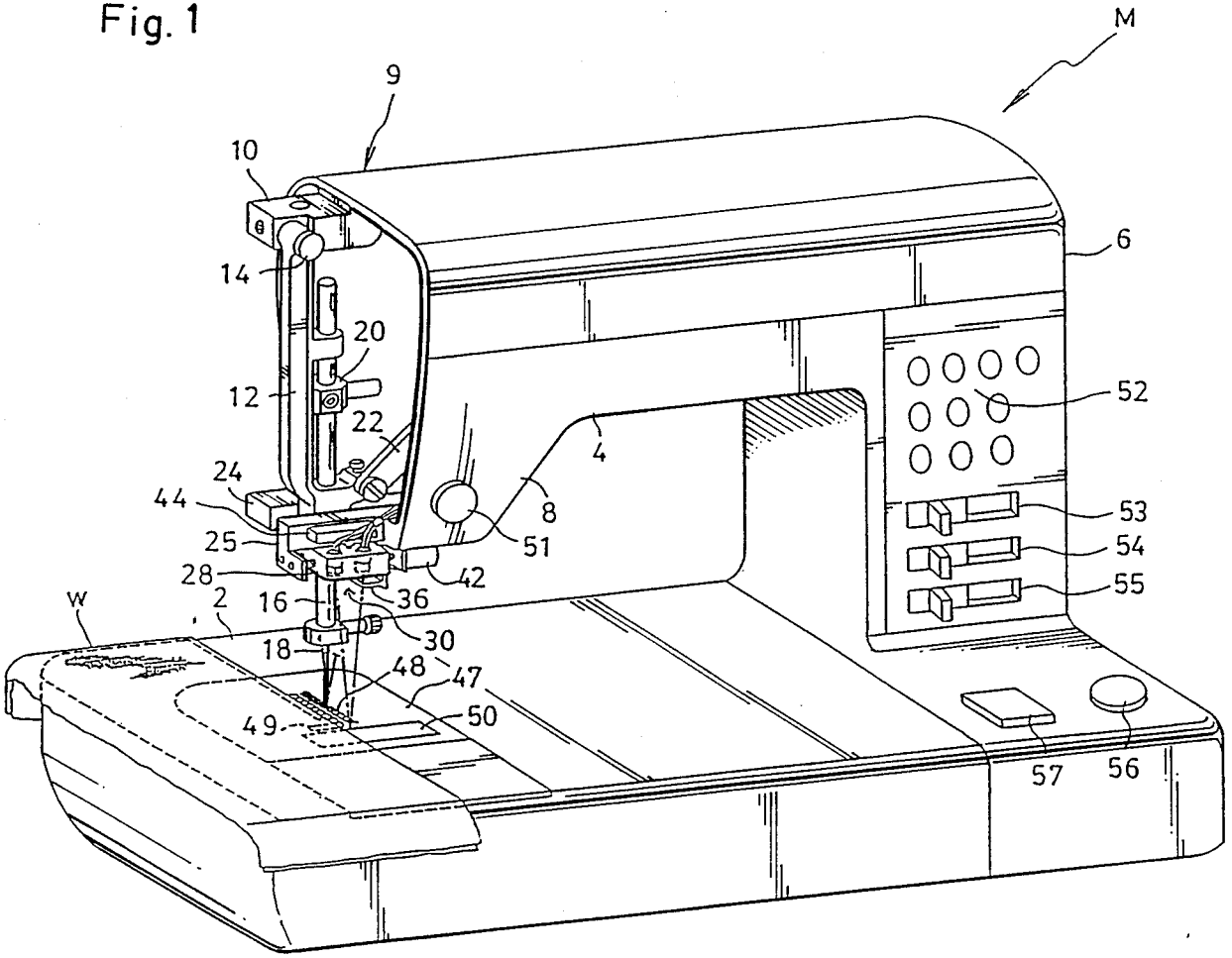
FIG. 1 is a perspective view showing the internal mechanisms of the head of the sewing machine in the embodiment of the present invention.

A preferred embodiment of the present invention will be described hereinafter with reference to the accompanying drawings. The present embodiment is a case where the present invention is applied to an electronically controlled sewing machine provided with a fabric edge trace stitching system.

An arm 4 of the sewing machine M, is provided with therein a needle bar vertically driving mechanism for vertical motion of a needle bar 16, a needle bar swing mechanism for lateral jogging motion of the needle bar 16, and a take-up lever driving mechanism.

A needle bar supporting member 12 is pivoted swingably at its top end on a supporting block 10 fixed to a head portion 8 of the arm 4, and the needle bar 16 is supported movably up and down on the needle bar supporting member 12, and a needle 18 is attached on the lower end of the needle bar 16. The needle bar 16 is operatively connected with the known main motor through a needle bar connecting stud 20, and the needle bar 16 supporting the needle 18 is driven reciprocatively up and down with driving force of the main motor. The lower end of the needle bar supporting member 12 is operatively connected with the swing control motor 69 through a connecting rod 22, and the needle 18 is driven laterally with the swing control motor through the supporting member 12 and the needle bar 16. A work supporting bed 2 is provided with therein a vertical feed driving mechanism for vertical motion of a feed dog 48 for feeding a work fabric, and a horizontal feed driving mechanism for forward/backward horizontal motion of the feed dog 48. The horizontal feed driving mechanism is driven with a feed control motor 66 (shown in FIG. 4 ), the needle bar vertically driving mechanism and the vertical feed driving mechanism and the take-up lever driving mechanism are driven with the main motor.

The head portion 8 is provided with a pair of guide members 24,25 disposed on the front and rear sides of the lower end of the supporting member 12 which are fixed to the head portion 8 and extending horizontally toward the left, thereby the lower end of the supporting member 12 is guided movably left and right.

Figure 2:
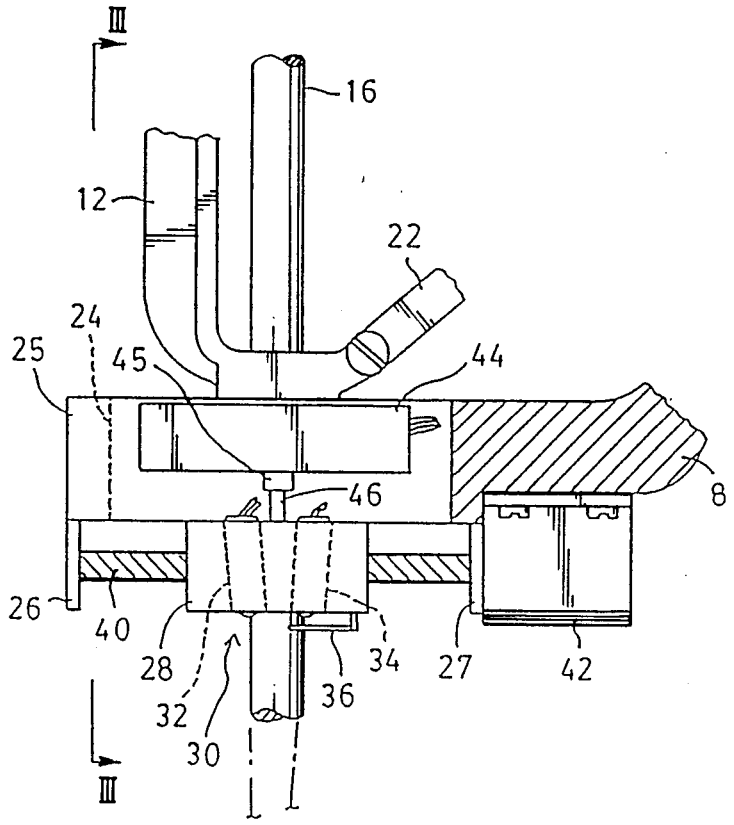
FIG. 2 is a front sectional view of the mechanical constitution of the fabric edge detecting device.
Figure 3:
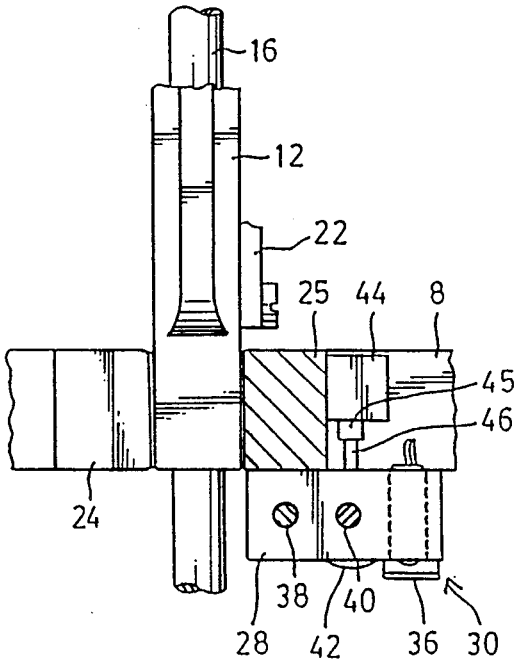
FIG. 3 is a sectional view taken on line III—III in FIG. 2.

As shown in FIG. 1~FIG. 3, a fabric edge detector 30 comprises a light-emitting device 32 for emitting infrared rays, a light-receiving device 34 for receiving infrared rays emitted from the light-emitting device 32, a socket member 28 for attaching the light-emitting device 32 and the light-receiving device 34 so as to keep a given angle between them and a reflective surface 50 fixed on a throat plate 47.

An optical filter 36 available only for infrared rays is disposed just below the light-receiving device 34 and is fixed to the socket member 28.

Through the rear portion of the socket member 28, a guide shaft 38 and a spindle shaft 40 parallel each other and extending laterally are penetrating, and each of their left ends is supported rotatably on a bracket 26 fixed to the guide member 25, and each of their right ends is supported rotatably on a bracket 27 fixed to the guide member 25. Furthermore, the right end of the spindle shaft 40 is connected with the drive shaft of a motor 42 for detection attached on the bottom of the head 8. Thus, the socket member 28 can be driven laterally through the spindle shaft 40 driven by the motor 42.

A fabric edge detecting device 44 is disposed above the socket member 28 and fixed to the guide member 25. The slide member 45 of the detecting device 44 is connected with a connecting rod 46 extending from the socket member 28.

Accordingly, the fabric edge detecting device 44 outputs a detected position voltage signal Vb representing the present position of the fabric edge detector 30 through movement of the slide member 45 when the socket member moves laterally (FIG. 4).

The throat plate 47 on the bed 2 is provided with plural slits, and the feed dog 48 is allowed to extrude through these slits, and the feed dog 48 is driven forward and backward with the horizontal feed driving mechanism driven by the feed control motor 66.

A needle hole 49 elongated laterally is perforated at the throat plate portion below the needle 18, and the reflective surface 50 extending laterally is attached on the top surface of the throat plate 47 below the socket member 28. This reflective surface 50 reflects the infrared rays emitted from the light-emitting device 32, and the light-receiving device 34 outputs a detected voltage signal Vs representing total amount of the reflected infrared rays at the reflective surface 50.

On the front side of the head 8, there is provided a start/stop switch 51. On the front side of the frame 9 of the standard 6, there are provided a stitch pattern selecting switch 52 consisting of ten-keys for selecting a desired stitch pattern a feed adjusting volume 53 for adjusting the feed amount of fabric feed, a swing adjusting volume 54 for adjusting the swing amount of the needle 18, a trace width setting volume 55 for setting the trace width between the stitching position and the fabric edge, a trace stitching switch 56 for setting fabric edge trace stitching of forming the seam along the fabric edge, and so on. Additionally, numeral 57 designates the power source switch.

Next, descriptions will be made on the control system of the sewing machine M with reference to FIG. 4.

The stitch pattern selecting switch 52 is connected to a stitch pattern selecting counter 58, and this counter 58 counts signals from the stitch pattern selecting switch 52 and supplies stitch pattern selecting signals to a stitch data generator 59. At the same time, the selected stitch pattern is displayed on a known displaying device. As stitch data for a plurality of stitch patterns, the stitch data generator 59 stores a plurality of stitch data each including a plurality of feed data and needle swing data for determining feed amount and swing amount in each stitching stroke, corresponding to respective stitch pattern Nos.. This stitch data generator 59 supplies feed data in the stitch data for the selected stitch pattern to a feed processing device 60, and also supplies needle swing data in the stitch data for the selected stitch pattern to a needle swing processing device 61, and this stitch data generator 59 is connected to a timing signal generator 62 which generates a timing pulse signal (TP) at every timing when the needle bar 16 reaches the uppermost position in its vertical reciprocation, and this stitch data generator 59 supplies the feed data and the needle swing data upon receiving the timing pulse signal (TP).

The feed processing device 60 is connected to a feed amount adjusting device 63, and the needle swing processing device 61 is connected to a swing amount adjusting device 64. The feed amount adjusting device 63 supplies digital feed adjusting signals corresponding to the selected feed amount selected with the feed amount adjusting volume 53. The feed processing device 60 compensates the feed data from the generator 59 based on the feed adjusting signal, and determines the number of drive pulse and feed direction based on the compensated feed data, and then supplies a drive pulse number signal and a feed direction signal to a feed drive control circuit 65.

The swing amount adjusting device 64 supplies digital needle swing adjusting signal corresponding to the selected swing amount from the swing adjusting volume 54. The needle swing processing device 61 compensates the needle swing data from the generator 59 based on the swing adjusting signal, and determines the number of drive pulse and swing direction based on the compensated needle swing data, and then supplies a drive pulse number signal and a swing direction signal to a needle swing control circuit 68 via a multiplexer 67.

Consequently, the feed drive control circuit 65 controls the feed control motor 66 based on the drive pulse number signal for feed and the feed direction signal, and the needle swing control circuit 68 controls the needle swing control motor 69 based on the drive pulse number signal for swing and the swing direction signal, thereby the feed amount of the feed dog 48 and the swing amount of the needle are controlled in each stitching stroke to form the selected stitch pattern selected with the stitch pattern selecting switch 52 on the work fabric W.

The trace stitching switch 56 is connected to the stitch pattern selecting counter 58 and the multiplexer 67, and these are supplied the trace stitching signal NS when the switch 56 is turned on. The counter 58 resets its counting value upon receiving this signal NS. Thus, stitch data generator 59 supplies feed data for the straight stitch to the feed processing device 60, and also supplies needle swing data equal to zero to the needle swing processing device 61. When the multiplexer 67 receives the trace stitching signal NS, the multiplexer 67 is switched to the state where the needle swing data from a trace stitching controller 70 is supplied to the needle swing control circuit 68.

Next, descriptions will be made on a fabric edge detecting controller 72 for controlling the fabric edge detector 30 so as to trace the edge of the work fabric W.

A comparator 74 compares the detected voltage signal Vs from the detector 30 with the reference voltage signal Ve from a voltage divider 73, and supplies a differential signal corresponding to the difference between the signal Vs and the reference signal Ve to a detection control circuit 75. This circuit 75 drives the edge detection motor 42 with the driving signal corresponding to the differential signal and its polarity. Thus, the fabric edge detector 30 is driven leftward or rightward by the fabric edge detection motor 42, thereby the detector 30 traces the edge of the work fabric W through infrared rays emitted from the light-emitting device 32.

Next, descriptions will be made on the trace stitching controller 70. An adder 76 is supplied with trace width setting voltage Vw, edge approximate voltage Vd obtained by approximating the detector position voltage Vb by a trace width compensating device 71, constant voltage Va and constant voltage Vc. The adder 76 carries out additional processing according to a formula ($Vp=Vc-Vd-Va-Vw$) upon receiving each timing pulse TP supplied from the timing pulse generator 62 via a OR gate 77, and supplies output voltage Vp to a A/D converter 78.

Figure 5:
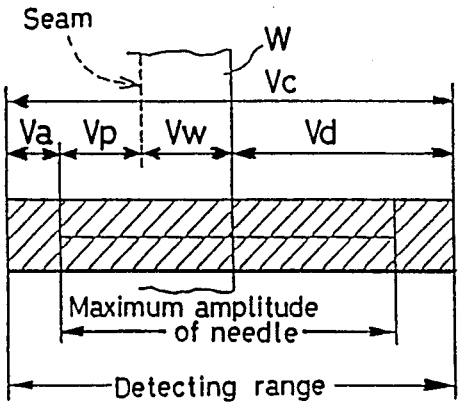
FIG. 5 is a explanatory diagram showing the needle position controls in fabric edge trace stitching.

As shown in FIG. 5, the constant voltage Va corresponds to the voltage of the distance from the left end of the maximum swing amplitude of the needle 18 to the left end of the detectable range of the fabric edge detecting device 44, and the constant voltage Vc corresponds to the voltage of the detectable range. The output voltage Vp corresponds to the voltage of the distance from the left end of the maximum swing amplitude to the stitching seam position, that is, the output voltage Vp is the needle position control voltage. The needle position control voltage Vp is converted into digital needle swing data by the A/D converter 78, and is supplied to the needle swing control circuit 68 via the multiplexer 67.

The timing signal generator 62 outputs the timing pulse signal TP only when the needle bar 16 reciprocates vertically with rotation of the main motor, and therefore, in order to operate the adder 76 during stopping of the main motor, the adder 76 is supplied with clock pulses from a clock pulse generator 80 via a AND gate 79 and a OR gate 77, only when the needle bar 16 is at the needle-up position (the needle-up signal is ⌜H⌟ level) and the main motor is in the stopped state (the sewing machine stop signal is ⌜H⌟ level).

Next, descriptions will be made on the trace width compensating device 71 for outputting the fabric edge voltage Vd by compensating the detected position voltage Vb.

Trace width compensating device 71 comprises a smoothed signal line L1 including a smoothing device 81 for stitching a smooth seam without tracing sudden deformation of the fabric edge in case of plain seam, a differentiated signal line L2 including a differentiator 83 and an adder 84 for stitching while tracing the fabric edge precisely in case of stitch seam, and a direct signal line L3 for outputting the detected position voltage Vb supplied from the fabric edge detecting device 44 without processing. The smoothed signal line L1 supplies the fabric edge voltage Vd obtained by smoothing the detected position voltage Vb to the adder 76 through a analog switch 82. The differentiated signal line L2 supplies the fabric edge voltage Vd obtained by differentiating the detected position voltage Vb to the adder 76 through a analog switch 85. The direct signal line L3 supplies the fabric edge voltage Vd equivalent to the detected position voltage Vb to the adder 76 through a analog switch 86.

Figure 6:
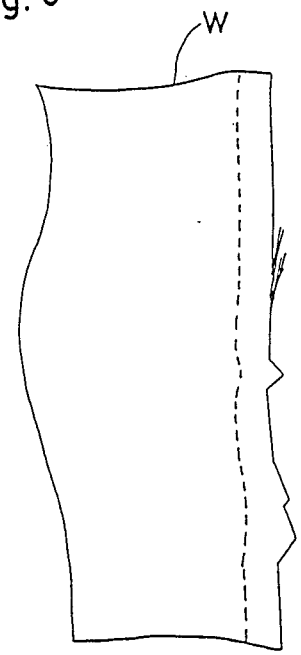
FIG. 6 is a plan view of the work fabric with a seam formed by fabric edge trace stitching carried out by use of the smoothed signal line.

The smoothing device 81 comprises a micro-computor including a CPU, a ROM and a RAM. This smoothing device 81 stores past four detected position voltages Vb detected in synchronism with the timing pulses into memories M1 to M4 respectively, and then stores the detected position voltage Vb upon receiving of the timing pulse TP into a memory M5, and then calculates the moving average of these data in memories M1 to M5, and then outputs its moving average signal as fabric edge voltage Vd to the adder 76. Additionally, the smoothing device 81 shifts data in memories M1 to M4 into memories M2 to M5 sequentially upon receiving another timing pulse TP. And that, this device 81 clears these memories M1 to M5 upon receiving of the trace stitching signal NS from the trace stitching switch 56. For example, as shown in FIG. 6, even when the edge of the work fabric W has plural irregularities or loosen portions, an approximately straight seam can be formed along the fabric edge.

Figure 7:
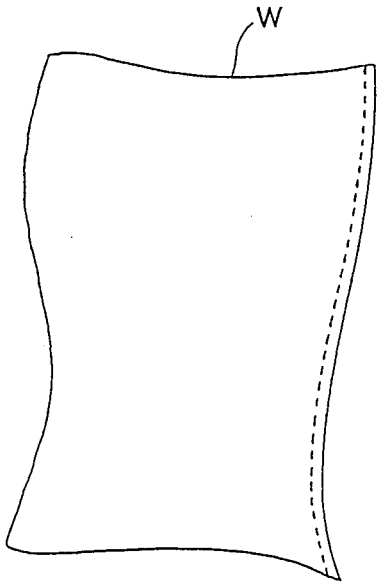
FIG. 7 is a plan view of the work fabric with a seam formed by fabric edge trace stitching carried out by use of the differentiated signal line.

The differentiator 83 comprises a micro-computor including a CPU, a ROM and a RAM. This differentiator 83 subtracts present detected position voltage Vb in synchronism with the timing pulse TP from previous newest detected position voltage Vb in synchronism with the timing pulse TP, and then multiplies the differential voltage by a predetermined constant value, and then supplies the multiplied differential voltage to the adder 84 as a detected displacement voltage $\Delta V$. The adder 84 adds the detected displacement voltage $\Delta V$ to present detected position voltage Vb, and then supplies the fabric edge voltage Vd to the adder 76. For example, as shown in FIG. 7, even when the work fabric W moves laterally during stitching with high speed, it is possible to form a seam tracing the fabric edge precisely.

Next, descriptions will be made on a switching device 87 for selecting one of the smoothed signal line L1, the differentiated signal line L2 and the direct signal line L3 by means of switching the analog switches 82, 85, 86. The trace width setting voltage Vw from the trace width setting volume 55 is supplied to plus terminals of comparators 88 and 89, and the voltage dividing point b of a voltage divider 90 consisting of three resistors is connected to the minus .terminal of the comparator 88, and the voltage dividing point a is connected to the minus terminal of the comparator 89. The relation between the dividing voltage Ea of the point a and the dividing voltage Eb of the point b and the reference voltage Vcc is $$0 \leqq Ea \leqq Eb \leqq Vcc.$$

Accordingly, when the trace width is set small through the trace width setting volume 55, the trace width setting voltage Vw is lower than the dividing voltage Ea, and therefore each of comparators 88, 89 outputs a low level signal. When the trace width is set medium, the trace width setting voltage Vw is higher than the dividing voltage Ea but lower than the dividing voltage Eb, and therefore the comparator 88 outputs a low level signal and the comparator 89 outputs a high level signal. When the trace width is set large, the trace width setting voltage Vw is higher than the dividing voltage Eb, and therefore each of the comparators 88, 89 outputs a high level signal.

Consequently, when starting stitching of the stitch seam after setting the trace width small, since a NAND gate 92 receives low level signals on its two input terminals, the NAND gate 92 outputs a high level signal, and the sewing machine stop signal SS is low level. Therefore, a AND gate 95 outputs a high level signal, and then the analog switch 85 is turned on to select the differentiated signal line L2. When starting stitching after setting the trace width medium, since a AND gate 91 receives a low level signal and a high level signal, the AND gate 91 outputs a high level signal, and therefore an OR gate 94 outputs a high level signal. Therefore, the analog switch 86 is turned on to select to direct signal line L3. When starting stitching after setting the trace width large, since an AND gate 93 receives a low level signal and a high level signal and the sewing machine stop signal SS is low level, the AND gate 93 outputs a high level signal, and thus the analog switch 82 is turned on to select the smoothed signal line L1.

Additionally, when sewing operation is stopping, since the sewing machine stop signal SS is high level, the OR gate 94 outputs a high level signal, and therefore the analog switch 86 is turned on to select the direct signal line L3.

Next, descriptions will be made on the trace stitching operation of the sewing machine M constituted as described above.

The operator sets the work fabric W on the bed 2 so that the fabric portion to be sewn corresponds to the approximate middle of the needle hole 49, and then the operator turns on the trace stitching switch 56. Thus, the stitch pattern selecting counter 58 is reset by the trace stitching signal NS, and therefore the stitch data generator 59 is switched to the state in which the straight stitching is selected. Furthermore, the multiplexer 67 is switched by the trace stitching signal NS to the state in which the needle position control signal Vp (i.e. the needle swing data) is supplied to the needle swing control circuit 68.

The fabric edge detector 30 supplies the comparator 74 with the detected voltage Vs corresponding to the amount of the reflected infrared rays in accordance with the position of the fabric edge. The comparator 74 supplies detection control circuit 75 with the differential signal corresponding to the differential voltage between the detected voltage Vs and the reference voltage Ve. Thus, the detection control circuit 75 controls the fabric edge detection motor 42, and therefore the fabric edge detector 30 is controlled so as to trace the fabric edge. Accordingly, the fabric edge detecting device 44 operatively connected with the fabric edge detector 30 outputs the detected position voltage Vb corresponding to the present position of the fabric edge detector 30 (i.e. the present position of the fabric edge).

At this time, as described above, since the OR gate 94 outputs the high level signal in accordance with the high level sewing machine stop signal SS, the analog switch 86 is turned on to select the direct signal line L3, and therefore the detected position voltage Vb is supplied as the fabric edge voltage Vd to the adder 76 through the analog switch 86. In this state, since the needle 18 is at the needle-up position and the main motor is stopping, the clock pulses from the clock pulse generator 80 are supplied to the adder 76 via the AND gate 79 and the OR gate 77.

Upon receiving of each clock pulse, the adder 76 calculates the needle position control voltage Vp and outputs it. This voltage signal Vp is supplied to the multiplexer 67 as the needle position control signal (i.e. the needle swing data) after being converted into digital signals by the A/D converter 78. The multiplexer 67 supplies this needle position control signal to the needle swing control circuit 68, and therefore the control circuit 68 controls the needle swing control motor 69 with the drive pulse number signal for swing and the drive direction signal which are obtained based on the needle position control signal. Thus, the needle 18 swings to the stitching position distant from the fabric edge by the trace width set.

Meanwhile, when the operator changes the trace width by operating the trace width setting volume 55, the trace width setting voltage Vw changes, and then the same control as described above is carried out according to this new trace width setting voltage Vw, and the needle 18 swings to the stitching position corresponding to the new trace width. When the operator turns on the start/stop switch 51 to start stitching operation after setting the trace width medium, the direct signal line L3 is selected, and thus the seam is formed at the stitching position corresponding to the trace width set with the trace width setting volume 55.

During trace stitching, when the fabric edge moves left or right, the fabric edge detector 30 moves left or right corresponding to the fabric edge, and the detected position voltage Vb output from the fabric edge detecting device 44 increases or decreases. And thus changing detected position voltage Vb is supplied as the fabric edge voltage Vd to the adder 76 from the direct signal line L3. Upon receiving of the timing pulse TP, the adder 76 calculates the needle position control voltage Vp based on the fabric edge voltage Vd, and this needle position control voltage Vp is supplied to the multiplexer 67 through the A/D converter 78. Thus, the same control as described above is carried out, and the needle 18 swings to the next stitching position.

When the operator sets the trace width small before starting of trace stitching, since each of the comparators 88,89 in the switching device 87 outputs the low level signal, the differentiated signal line L2 is selected. The differentiator 83 outputs the detected displacement voltage $\Delta V$ based on the past newest detected position voltage Vb and the present detected position voltage Vb, and the adder 84 adds the detected displacement voltage ΔV to the present detected position voltage Vb and outputs the fabric edge voltage Vd through the analog switch 85 to the adder 76. Thus, the same control as described above is carried out, and the needle 18 swings to the next stitching position. Therefore, even when the work fabric W moves suddenly left or right during trace stitching with high speed, the trace stitching can be carried out while tracing precisely along the fabric edge, as shown in FIG. 7.

When the operator sets the trace width large before starting of trace stitching, since each of the comparators 88, 89 outputs the high level signal, the smoothed signal line L1 is selected. Accordingly, the smoothing device 81 calculates the moving average of the past four detected position signals Vb stored in the memories M1 to M4 and the present detected position signal Vb in synchronism with the timing pulse TP for commanding the next stitching stroke, and this moving average is supplied as the fabric edge voltage Vd to the adder 76 through the analog switch 82. Therefore, even when the fabric edge has sudden deformations or loosened portions as shown in FIG. 6, the trace stitching tracing approximately along the fabric edge can be carried out, and a smoothed seam can be formed.

Additionally, the needle position control signal Vp represents the absolute position of the needle 18 relative to the left end of the maximum swing amplitude of the needle 18. Therefore, although not shown in FIG. 4, actually, it is necessary to provide a compensating circuit for compensating the needle position control signal Vp to be an incremental position signal relative to the past newest position of the needle 18.

Meanwhile, it may be possible to provide a shift switch for selecting manually one of the smoothed signal line L1, the differentiated signal line L2 and the direct signal line L3.

As described hereinbefore in the descriptions of the embodiment of the present invention, when the smoothed signal line L1 is selected, a seam tracing smoothly and approximately along the fabric edge can be formed for the plain seam without influences of the sudden deformation or loosened portions of the fabric edge. When the differentiated signal line L2 is selected, a seam tracing precisely along the fabric edge can be formed for the stitch seam, and therefore it is possible to carry out trace stitching with high sewing speed. When the direct signal line L3 is selected, it is possible to carry out the same trace stitching as conventional trace stitching.

Accordingly, it is possible to change the degree of tracing along the fabric edge, and therefore it is possible to improve the flexibility and serviceability of the sewing machine including the fabric edge trace stitching system.

Additionally, the control system shown in FIG. 4 may be constituted with a control system comprising mainly a micro-computor, and various modifications or improvements may be applied to the trace stitching controller 70, the trace width compensating device 71, the fabric edge detecting controller 72 and the switching device 87, respectively.

Additionally, the present invention can be applied to an electronically controlled sewing machine comprising a lateral feed mechanism driven by an electronically controlled motor, for feeding the work fabric in a lateral direction perpendicular to the feed direction for feeding the work fabric.

What is claimed is:

1. A fabric edge trace stitching system in combination with a sewing machine including; a bed for supporting a work fabric to be sewn, a needle movable for vertical reciprocation, a driving actuator driven for changing a relative position of the needle and the work fabric in a direction perpendicular to a feed direction for feeding the work fabric, and a drive control means for controlling the driving actuator in synchronism with the vertical reciprocation of the needle;

the fabric edge trace stitching system is characterized by comprising;

a fabric edge detecting means for detecting an edge of the work fabric on the bed, a trace width setting means for setting a trace width from the fabric edge to a stitching position, a signal compensating means for receiving a fabric edge position signal supplied from the fabric edge detecting means, and including a signal smoothing means for smoothing the fabric edge position signal and a signal passing means for passing the fabric edge position signal without processing, a stitch position control means for commanding the drive control means to control the driving actuator so as to stitch at the stitching position distant from the fabric edge by the trace width set with the trace width setting means, based on the fabric edge position signal supplied from the signal compensating means, and a switching means for switching one of the signal smoothing means and the signal passing means to be operative.

2. A fabric edge trace stitching system according to claim 1; wherein the signal compensating means further comprises a signal differentiating means for differentiating the fabric edge position signal, and the switching means is constituted to switch one of the signal smoothing means, the signal passing means and the signal differentiating means to be operative.

3. A fabric edge trace stitching system according to claim 2; wherein the switching means is connected to the trace width setting means, and switches the signal smoothing means to be operative when the trace width is set large, and switches the signal passing means to be operative when the trace width is set medium, and switches the signal differentiating means to be operative when the trace width is set small.

4. A fabric edge trace stitching system according to claim 2; wherein the switching means is constituted with a shift switch to be operated manually.

* * * * *